United States Patent [19]

Shaffer

[11] Patent Number: 4,550,895

[45] Date of Patent: Nov. 5, 1985

[54] RAM CONSTRUCTION FOR OIL WELL BLOW OUT PREVENTER APPARATUS

[76] Inventor: Donald U. Shaffer, 2850 E. Coronado St., Anaheim, Calif. 92806

[21] Appl. No.: 654,162

[22] Filed: Sep. 24, 1984

[51] Int. Cl.[4] ..... E21B 33/06

[52] U.S. Cl. ..... 251/1.3

[58] Field of Search ..... 251/1 R, 1 A; 277/206 R

[56] References Cited

U.S. PATENT DOCUMENTS

| | | | |
|---|---|---|---|
| 1,989,429 | 1/1935 | Segelhorst et al. | 277/126 |
| 3,366,392 | 1/1968 | Kennel | 277/177 |
| 3,434,729 | 3/1969 | Shaffer et al. | 277/181 |
| 3,592,491 | 7/1971 | Glover | 285/230 |
| 3,656,763 | 4/1972 | Joubert et al. | 277/63 |
| 3,897,040 | 7/1975 | LeRouax | 251/1 B |
| 3,915,425 | 10/1975 | LeRouax | 251/1 A |
| 3,915,426 | 10/1975 | LeRouax | 251/1 A |
| 3,969,018 | 9/1975 | Chaplain | 277/206 A |
| 4,089,532 | 5/1978 | Kamyshnikov et al. | 277/129 |
| 4,138,144 | 2/1979 | Pierce, Jr. | 285/18 |
| 4,229,012 | 10/1980 | Williams, III | 277/127 |
| 4,265,424 | 5/1981 | Jones | 251/1 A |
| 4,283,039 | 8/1981 | Schaeper et al. | 251/1 B |
| 4,323,256 | 4/1982 | Miyagishima et al. | 277/126 |
| 4,332,367 | 6/1982 | Nelson | 251/1 A |

*Primary Examiner*—Samuel Scott
*Assistant Examiner*—Allen J. Flanigan
*Attorney, Agent, or Firm*—Poms, Smith, Lande & Rose

[57] ABSTRACT

A ram seal element adapted for use with a ram block and ram block holder in a blow out preventer apparatus to provide sealing of drill strings of varying diameters. The ram seal element is a semi-circular elastomer having a diametrical portion and a circumferential portion. The diametrical portion includes a center collar section and two side sections with the collar section being adapted for sealing contact with the drill string. The diametrical portion is provided on its outer side surface with a longitudinal channel defining an expansion zone into which the seal can expand uniformly to accommodate drill strings of increasing size.

16 Claims, 7 Drawing Figures

Fig. 3.
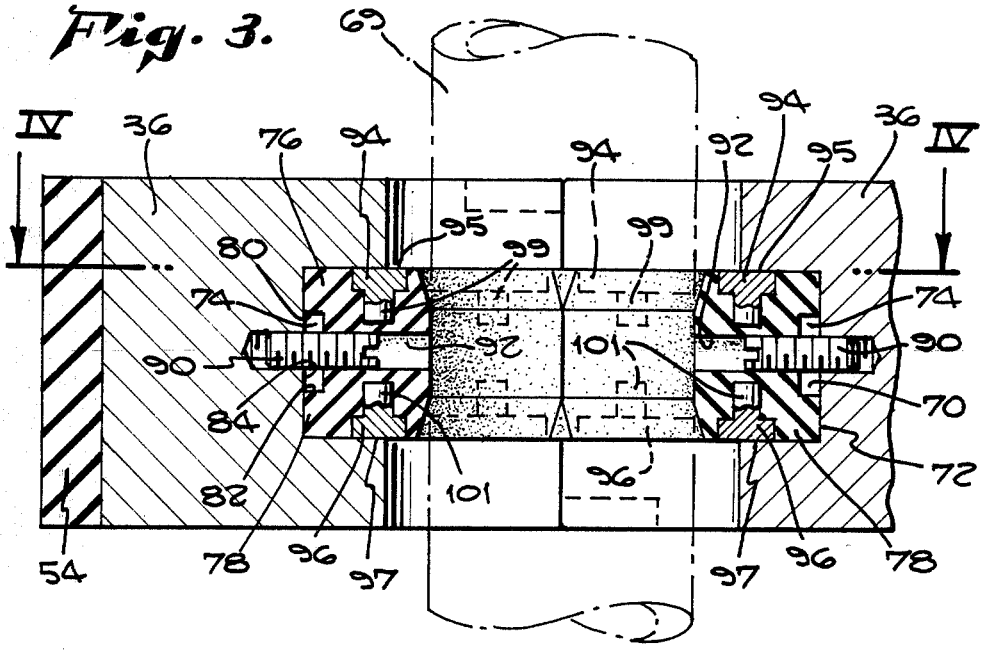
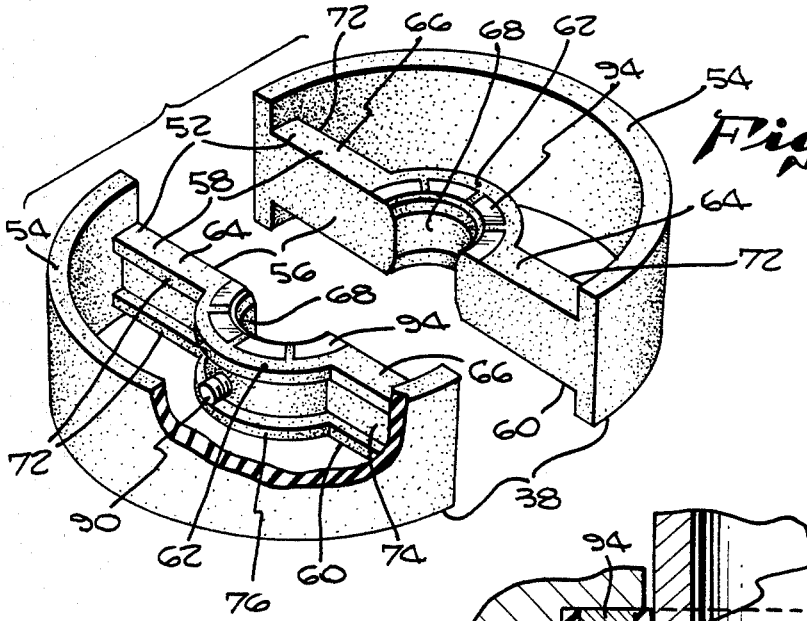
Fig. 7.
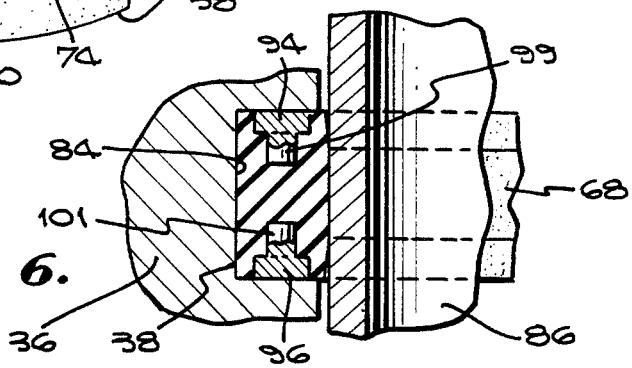
Fig. 6.

RAM CONSTRUCTION FOR OIL WELL BLOW OUT PREVENTER APPARATUS

BACKGROUND OF THE INVENTION

The present invention relates generally to blow out preventers for use in preventing blow out of well pressure during oil well and other drilling operations. More particularly, the present invention relates to ram type blow out preventers which are commonly used to prevent blow out of well pressures in relatively high pressure wells.

Ram type blow out preventers basically include a resilient ram seal, a ram block for biasing the ram seal against the drill string to provide desired sealing, and a ram block holder for mounting the ram block and ram seal within the blow out preventer assembly. Ram seals have been conventionally made from elastomeric materials such as rubber. The ram seal usually includes two ram seal elements which are semi-circular elastomer bodies having a diametrical portion and a circumferential portion. The diametrical portion of each seal element generally includes a central collar section. The two seal elements are typically mounted within the ram block so that the central collar sections are aligned to provide a central orifice through which the drill string is passed.

Many times it is desirable to change the diameter of the drill string during drilling operations. Attempts have been made to design a ram assembly which is capable of accommodating different sized drill strings. Such a variable diameter ram seal assembly is especially desirable since it would avoid the necessity of having to change the ram seal assembly every time a change in drill string diameter is made.

The ram type blow out preventer disclosed in U.S. Pat. No. 3,897,040 is an example of an attempt to provide a variable inside diameter ram seal. This seal assembly is designed to be normally in a full-open bore position to accommodate the larger drill string diameters with means being provided to force the seal element inward to provide sealing of smaller drill strings. Although this particular variable diameter ram seal assembly may be well suited for its intended purpose, there is still a continuing need to provide improved ram type seal assemblies which are capable of providing positive, leak-free sealing of variable diameter drill strings at relatively high pressure of 5,000 p.s.i. and above.

SUMMARY OF THE INVENTION

In accordance with the present invention, an improved ram seal assembly is disclosed which is capable of sealing variable diameter drill strings to prevent blow out of well pressure. The present invention is based upon an improved ram seal element for use in the ram assembly of a blowout preventer. The ram seal element is adapted to provide sealing of variable diameter drill strings to prevent blow out of well pressure when the drill strings are in use within the well.

The ram seal element includes a semi-circular elastomer having a diametrical portion and a circumferential portion. The diametrical portion includes an inner side sealing surface, top and bottom surfaces and an outer side surface. The diametrical portion includes a central collar section and two side sections with the collar section having an inner surface which defines an arcuate recess in the sealing surface of the diametrical portion for sealing contact with the drill string. The outer side surface of the diametrical portion, in accordance with the present invention, is adapted for contact with the ram block and includes a longitudinal channel extending substantially the entire length of the diametrical portion. The channel is sealed off from the well pressure and defines an expansion zone between the diametrical portion and the ram block into which elastomeric seal material can expand when the seal is used to seal drill strings of increasing diameter.

The collar section of the seal element is sized so that when two seal elements are positioned in their respective ram blocks, they form an orifice for sealing to the smaller diameter drill strings. As a particular feature of the present invention, the expansion zone on the back surface of the diametrical portion of each seal element is of sufficient size to allow expansion of the seal elements into their respective expansion zones when larger diameter drill strings are inserted into the seal orifice. As another feature of the present invention, the expansion zone is sealed off from the well pressure in order to insure adequate and uniform expansion of the sealing material into the expansion zone when larger diameter drill strings are being accommodated. As a further feature, the expansion zone extends the entire length of the seal element diametrical portion in order to provide uniform and symmetrical expansion of the drill string orifice without undesirable deformation of the seal.

The ram seal element and ram seal assembly in accordance with the present invention provide a seal orifice which in the normal, or unexpanded position, is adapted to provide sealing of smaller diameter drill strings. In order to accommodate larger diameter drill strings, the seal element is designed to expand without deformation to provide a suitable seal. This is quite different from, and an improvement over, conventional prior art systems in which the ram seal assembly in its normal position is designed to accommodate larger diameter drill strings with sealing of smaller diameter drill strings being provided by forcing the seal element inward.

The above discussed and many other features and attendant advantages of the present invention will become apparent as the invention becomes better understood by reference to the following detailed descripton when considered in conjunction with the accompanying drawings.

BRIEF DESCRIPTION OF THE DRAWINGS

FIG. 3 is a sectional view of FIG. 2 taken in the III—III plane.

FIG. 6 is a sectional view of FIG. 5 taken in the VI—VI plane.

FIG. 7 is a perspective view of two exemplary preferred ram seal elements in accordance with the present invention.

DETAILED DESCRIPTION OF THE INVENTION

Figure 1:
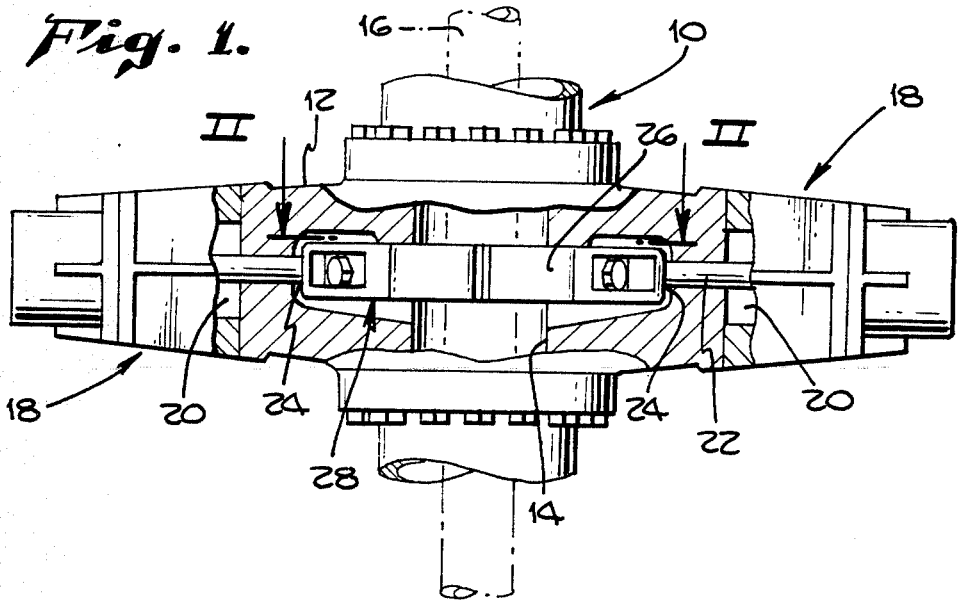
FIG. 1 is a side partial sectional view of a blow out preventer in which an exemplary preferred ram seal assembly is located.

A control gate is shown generally at 10 in FIG. 1. The control gate 10 is a conventional control gate which is disclosed in U.S. Pat. No. 3,434,729, which is assigned to Shaffer Tool Works, Brea, Calif. The contents of this patent is hereby incorporated by reference.

The control gate has a body 12 with a vertical bore 14 therethrough. The vertical bore 14 is of sufficient size to accommodate various drill string elements such as drill tubes and kellys. A drill string 16 is shown in phantom passing vertically through the bore 14.

The hydraulic mechanism shown generally at 18 is a conventional hydraulic device for providing biasing force for the ram blocks. The hydraulic mechanism 18 includes a cylinder 20 in which is operably disposed a piston (not shown) having a piston rod 22 which extends through a bore provided therefor in the body 12. The inner end of the piston rod 22 is connected at 24 to the ram block holder 26. The hydraulic mechanism 18 provides the biasing force for biasing the seal element against the drill string 16 as will be described in detail below.

Figure 2:
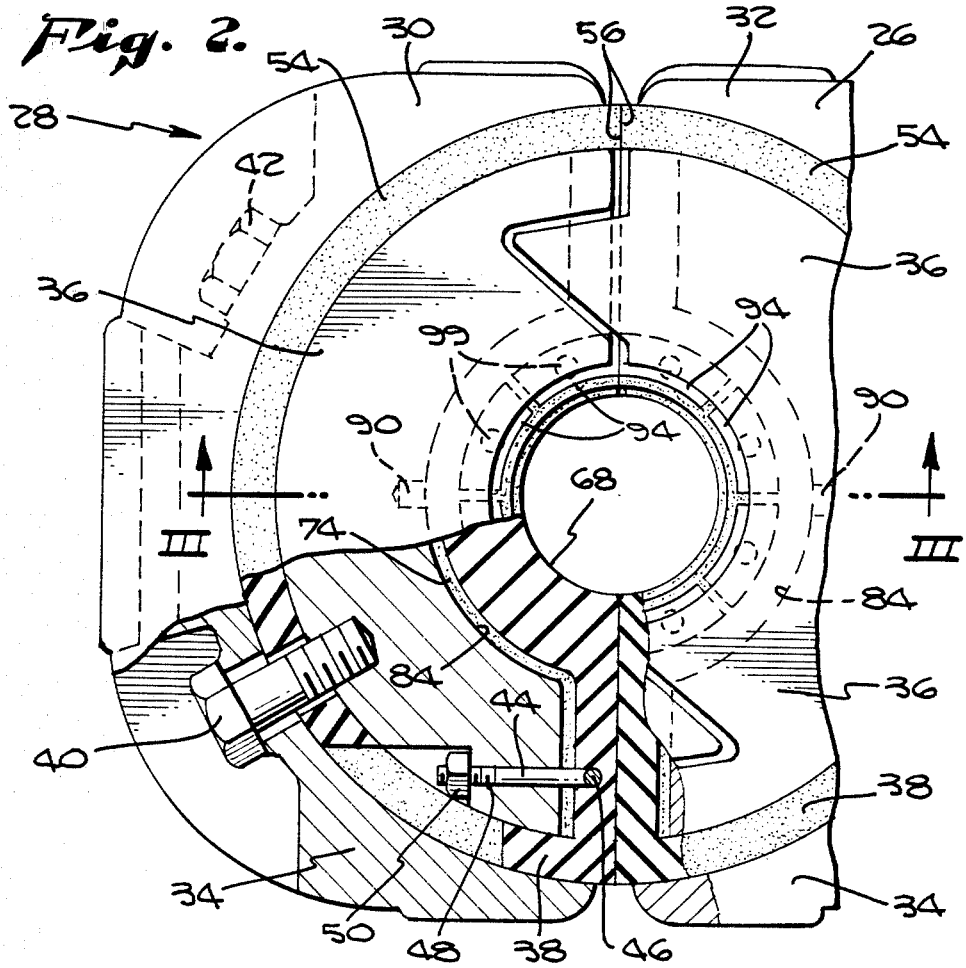
FIG. 2 is a sectional view of FIG. 1 taken in the II—II plane.

The ram seal assembly which is shown generally at 28 in FIGS. 1 and 2 is a ring-shaped assembly having two identical halves 30 and 32. Since the two halves 30 and 32 are identical, the following descripton will deal with identification of the elements and structure of the left half 30 with the same numbers being used to identify the corresponding elements in the right half of the seal assembly 32.

The left half of the seal assembly 30 includes a ram block holder 34, ram block 36 and ram seal element 38. The ram block holder 34 is designed for mounting a ram block 36 and a ram seal element 38 within the control gate or block out preventer 10. The general description of the function of the ram block holder 34, ram block 36 and ram seal 38 is set forth in detail in previously mentioned U.S. Pat. Mo. 3,434,729. Bolts 40 and 42 are provided for securing the ram block 36 to the ram block holder 34. Fasteners 44 (only one shown) are connected at one end 46 to the ram seal element 38 with the other end 48 being adapted to receive a nut 50 which provides fastening of the ram seal element 38 to the ram block 36.

The ram seal elements 38, as best shown in FIG. 7, are semi-circular elastomer bodies having a diametrical portion 52 and a circumferential portion 54. The ram seal element 38 is preferably made from a resilient elastomer such as natural or synthetic rubber or other elastomers having similar physical properties. The various types of elastomer materials utilized for making ram seal elements are well known and any of the conventionally used materials are suitable for use in accordance with the present invention.

Figure 4:
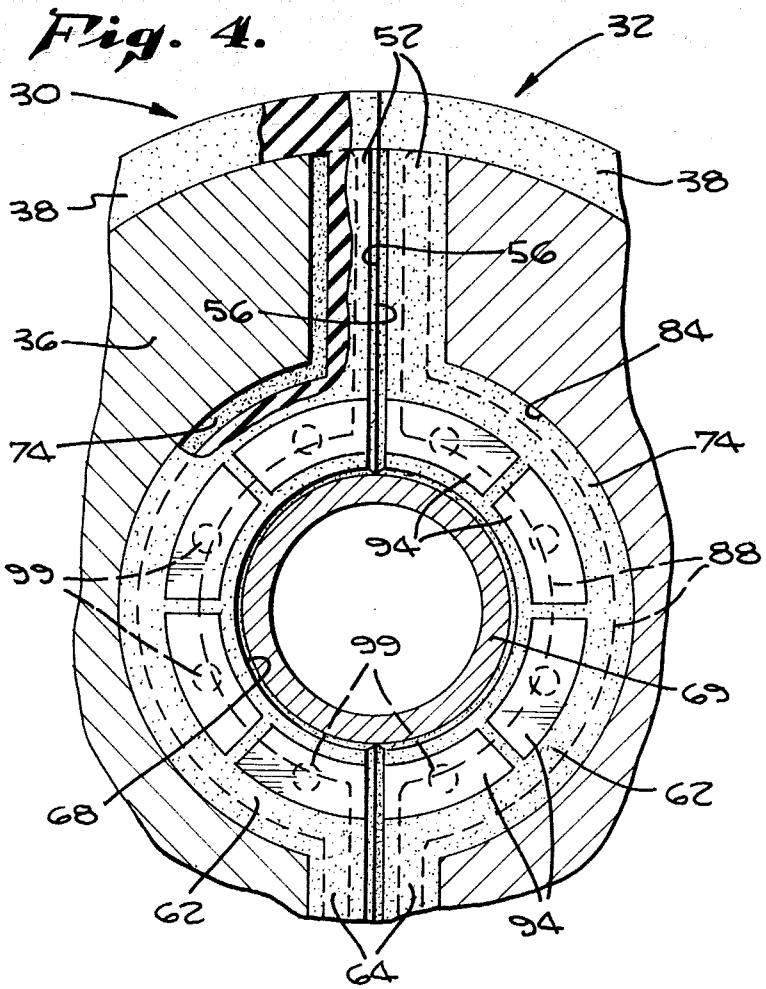
FIG. 4 is a sectional view of FIG. 3 taken in the IV—IV plane showing the ram seal assembly in sealing position about a smaller diameter drill string.

The diametrical portion 52 includes an inner side sealing surface 56, top surface 58 and bottom surface 60. The diametrical portion also includes a central collar section 62 and two side sections 64 and 66. The collar section 62 includes an inner surface 68 which defines an arcuate recess in the sealing surface 56. The arcuate surfaces 68 are sized so that when the two seal elements are mounted within the ram block 36, they form a drill string orifice which is sized to seal around relatively small diameter drill strings such as small diameter drill string 69 as best shown in FIG. 4. Typical diameters for the smaller sized drill strings are from 3 to $3\frac{1}{2}$ inches.

The large diameter drill strings range up to diameters of $4\frac{1}{2}$ inches and more. In order to accommodate these larger diameter drill strings, the seal element 38 is provided with a longitudinal channel 70 which extends substantially along the entire length of the outer side surface 72 of diametrical portion 52. As best shown in FIG. 3, the longitudinal channel 70 forms an expansion zone 74 into which the ram seal element can expand when larger diameter drill strings are being sealed.

Figure 5:
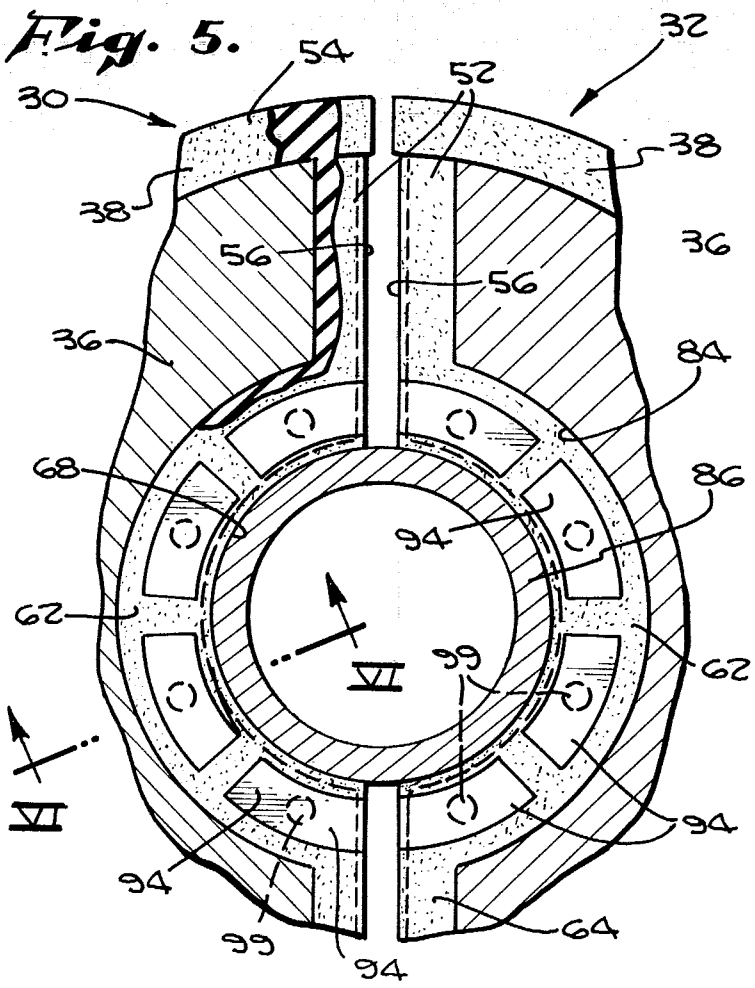
FIG. 5 is the same sectional view as FIG. 4 showing the seal assembly sealed about a large diameter drill string.

Although various different channel configurations are possible, it is preferred that the diametrical portion include an upper ride 76 and a lower ridge 78, each of which extends longitudinally across the outer side surface 72 as best shown in FIGS. 3 and 7. The upper ridge 76 includes a lower surface 80 with the lower ridge 78 including an upper surface 82. The surfaces 80 and 82 define the top and bottom of the channel respectively. The surfaces 80 and 82 are preferably perpendicular to the contact face 84 of the ram block 36. The size of the expansion zone 74 is preferably sufficiently large to allow uniform expansion of the seal element into the expansion zone 74 when larger diameter drill strings such as pipe 86 in FIG. 5 are being sealed. The amount of expansion required by the seal element is represented in phantom at 88 in FIG. 4.

The expansion zone should be of sufficient size to allow the necessary volume expansion of elastomeric material from the seal in order to accommodate the desired larger drill string diameter. The provision of such a longitudinal expansion zone provides uniform and non-deformed expansion of the center collar sections 62 to thereby provide a uniform and pressure tight seal around the larger diameter drill string 86. The expansion zone must be sealed off from communication with the well in order to prevent the possibility of pressurizing the expansion zone 74 to thereby prevent the desired movement or expansion of elastomeric material into the expansion zone 74 during sealing of the relatively larger diameter drill strings. As shown in FIG. 6, it is preferred that the longitudinal channel 70 in each of the two sealing elements on either side of the drill string be sized so that the expansion zone 74 defined by the channels is filled with elastomer when the upper diameter limit of the seal is reached.

The ram seal element 38 is provided with a positioning and fastening screw 90 which allows threaded engagement of the seal element 38 with the ram block 36 as best shown in FIG. 3. The screw fasteners 90 must be headless or otherwise designed to fit within recessed holes 92 to insure that they do not interfere with the sealing action of arcuate sealing surfaces 68.

In order to reduce deformation and extrusion of the center collar section 62, a plurality of upper reinforcement bars 94 and lower reinforcement bars 96 are located in the collar section 62. The reinforcement bars 94 and 96 are molded into or otherwise securely mounted integrally within the seal element collar section 62. The rigid bars 94 and 96 include outer surfaces 95 and 97, respectively. The bars 94 and 96 are mounted in the collar section 62 so that the surfaces 95 and 97 are flush with the top and bottom surfaces 58 and 60, respectively. Preferably, the bottom or inner surfaces of the rigid bars 94 and 96 include dowel pins 99 and 101, respectively. (See FIGS. 3 and 6). The dowel pins 99 and 101 fit matingly within holes in the rigid bars to provide a preferred means for securing the rigid bars 94 and 96 to the collar section 6.2. The dowel pins 99 and 101 are preferably cemented or otherwise secured into their respective holes in the collar section 6.2.

The rigid bars 94 and 96 are preferably made from a rigid material such as resin/fiber composite materials, steel and other structurally strong and rigid materials. The rigid bars 94 and 96 are located at spaced locations annularly around the central collar section 62 to provide the desired reinforcement and resistance to extrusion and elastomer flow necessary to prevent extrusion of the relatively soft elastomer seal when high well pressures are present.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A ram seal element for use in the ram assembly of a blow out preventer, said ram seal element being adapted to provide sealing of variable diameter drill strings to prevent blow out of well pressure when said drill strings are in use within said well, said ram assembly including a ram block for biasing said ram seal element against said drill string and a ram block holder for mounting said ram block within said blow out preventer, said ram seal element comprising:

a semi-circular elastomer having a diametrical portion and a circumferential portion, said diametrical portion having an inner side sealing surface, top and bottom surfaces and an outer side surface, said diametrical portion further including an elastomer central collar section and two elastomer side sections, said collar section having an inner surface defining an arcuate recess in the sealing surface of said diametrical portion for sealing contact with a drill string, wherein the outer side surface of said diametrical portion is adapted for contact with said ram block, said ram block being movable toward said drill string to bias said diametrical portion against said drill string, said outer surface including a longitudinal channel therein extending substantially the entire length of both said central collar section and side sections of said diametrical portion and being sealed off from said well pressure, said channel defining an expansion zone between said diametrical portion and said ram block when said ram seal element is in sealing portion in said ram assembly, wherein said expansion zone has a sufficient volume to allow uniform expansion of said diametrical portion into said expansion zone when said seal is used to seal drill strings of increasing diameter, said seal element thereby being useful to provide sealing of variable diameter drill strings to prevent blow out of well pressure when said drill strings are in use within said well.

2. A ram seal element according to claim 1 wherein said inner side sealing surface and said outer side surface are substantially parallel.

3. A ram seal element according to claim 1 wherein means associated with said outer side surface are provided for aligning and mounting said seal element relative said ram block.

4. A ram seal element according to claim 1 wherein said diametrical portion of said seal element includes an upper ridge and a lower ridge extending longitudinally across said outer side surface, said upper ridge being adjacent said diametrical portion top surface and said lower ridge being adjacent said diametrical portion bottom surface, said upper ridge having a lower surface and said lower ridge having an upper surface, said ridge upper and lower surfaces defining a bottom and a top of said channel.

5. A ram seal element according to claim 1 wherein said diametrical portion includes anti-extrusion means for preventing deformation of said collar.

6. A ram seal element according to claim 5 wherein said anti-extrusion means include a plurality of rigid bars located at spaced locations along the top and bottom surfaces of said collar portion, said rigid bars having outer surfaces which are mounted flush with the bottom or top surfaces of said collar.

7. A ram seal element according to claim 6 wherein said rigid bars including inner surfaces having dowel pins extending therefrom into said collar to secure said rigid bars to said collar.

8. A ram seal element according to claim 7 wherein said collar is sized to fit smaller diameter drill strings, said collar being sufficiently resilient to expand outward to accommodate larger diameter drill strings.

9. A ram assembly for use in a blow out preventer, said ram assembly being adapted to provide sealing of variable diameter drill strings to prevent blow out of well pressure when said drill strings are in use within said well, said ram assembly comprising:

a ram block;

a ram block holder for mounting said ram block within said blow out preventer; and two ram seal elements disposed on opposite sides of said drill string, each of said ram seal elements comprising a semi-circular elastomer body having a diametrical portion and a circumferential portion, said diametrical portion having an inner side sealing surface, top and bottom surfaces and an outer side surface, said diametrical portion further including an elastomer central collar section and two elastomer side sections, said collar section having an inner surface defining an arcuate recess in the sealing surface of said diametrical portion for sealing contact with the drill string, wherein the outer side surface of said diametrical portion is adapted for contact with said ram block, said ram block being movable toward said drill string to bias said diametrical portion against said drill string, said outer surface including a longitudinal channel therein extending substantially the entire length of both said central collar section and side sections of said diametrical portion and being sealed off from said well pressure, said channel defining an expansion zone between said diametrical portion and said ram block when said ram seal element is in sealing position in said ram assembly, wherein said expansion zone has a sufficient volume to allow uniform expansion of said diametrical portion into said expansion zone when said seal is used to seal drill strings of increasing diameter, said seal element thereby being useful to provide sealing of variable diameter drill strings to prevent blow out of well pressure when said drill strings are in use within said well.

10. A ram assembly according to claim 9 wherein said inner side sealing surface and said outer side surface are substantially parallel.

11. A ram assembly according to claim 9 wherein means associated with said outer side surface are provided for aligning and mounting said seal element relative said ram block.

12. A ram assembly according to claim 9 wherein said diametrical portion of said seal element includes an upper ridge and a lower ridge extending longitudinally across said outer side surface, said upper ridge being adjacent said diametrical portion top surface and said lower ridge being adjacent said diametrical portion bottom surface, said upper ridge having a lower surface and said lower ridge having an upper surface, said ridge upper and lower surfaces defining a bottom and a top of said channel.

13. A ram assembly according to claim 9 wherein said diametrical portion includes anti-extrusion means for preventing deformation of said collar.

14. A ram seal assembly according to claim 13 wherein said anti-extrusion means includes a plurality of rigid bars located at spaced locations along the top and bottom surfaces of said collar portion, said rigid bars having outer surfaces which are mounted flush with the bottom or top surfaces of said collar.

15. A ram seal comprising two ram seal elements in accordance with claim 1 having their sealing surfaces located adjacent each other with the center collar sections aligned to provide a drill string orifice in which variable sized drill strings are sealed by said ram seal.

16. In a ram seal for use in sealing variable diameter drill strings to prevent blow out of well pressure, wherein said ram seal includes two seal elements each of which comprises a semi-circular elastomer body having a diametrical portion and a circumferential portion, said diametrical portion having an inner side sealing surface, top and bottom surfaces and an outer side surface, said diametrical portion further including an elastomer central collar seciton and two elastomer side sections, said collar section having an inner surface defining an arcuate recess in the sealing surface of said diametrical portion for sealing contact with a drill string, wherein said seal elements are located on opposite sides of the drill string to form a circular ram seal having a central drill string orifice defined by the arcuate recesses in said diametrical portions of the seal elements, said seal elements defining a first small diameter orifice when said seal elements are in an unexpanded position and said seal elements defining a second large diameter orifice when they are in an expanded position, wherein the improvement comprises:

providing said outer side surface of each seal element with a longitudinal channel therein extending substantially the entire length of both said central collar section and side sections of said diametrical portion, said channel being sealed off from said well pressure, said channel defining an expansion zone having sufficient volume to allow uniform expansion of said seal elements into said expansion zone when said seal elements are moved from said unexpanded position for sealing to relatively small diameter drill strings to said expanded position for sealing to drill strings relatively large diameters.

* * * * *